US005195900A

United States Patent [19]

Kumagai et al.

[11] Patent Number: 5,195,900

[45] Date of Patent: Mar. 23, 1993

[54] ADJUSTABLE POSITION CONNECTOR MOUNTING STRUCTURE

[75] Inventors: Fumio Kumagai; Mamoru Ono, both of Aichi, Japan

[73] Assignee: Yazaki Corporation, Japan

[21] Appl. No.: 769,454

[22] Filed: Oct. 1, 1991

[30] Foreign Application Priority Data

Oct. 2, 1990 [JP] Japan ..... 2-103375[U]
Jan. 7, 1991 [JP] Japan ..... 3-002739[U]

[51] Int. Cl.[5] ..... H01R 13/73

[52] U.S. Cl. ..... 439/131; 248/185; 439/364

[58] Field of Search ..... 439/131, 34, 534, 364; 248/185, 291, 222.2; 403/93

[56] References Cited

U.S. PATENT DOCUMENTS

| | | | |
|---|---|---|---|
| 2,403,324 | 7/1946 | Anderson | 248/185 |
| 2,691,721 | 10/1954 | Bornhuetter | 248/291 |
| 4,073,455 | 2/1978 | Gunther | 403/93 |
| 4,480,809 | 11/1984 | Healey | 248/185 |
| 4,986,762 | 1/1991 | Keith | 439/534 |
| 5,056,952 | 10/1991 | Gringer | 403/93 |

FOREIGN PATENT DOCUMENTS

| | | |
|---|---|---|
| 60-19164 | 2/1985 | Japan . |
| 60-22775 | 2/1985 | Japan . |
| 60-22776 | 2/1985 | Japan . |

*Primary Examiner*—Neil Abrams
*Attorney, Agent, or Firm*—Wigman & Cohen

[57] ABSTRACT

A connector-mounting structure for mounting a pair of mating connectors for connecting wires conducting electrical current comprises a bracket which is mounted to a member of an automobile, for example. A first connector which houses a plurality of first terminals with wires connected thereto is placed in the bracket. A second connector which houses a plurality of second terminals with wires connected thereto is connected to the first connector. Pivot pins, slots or slot and a hole, and stopping members are formed in the bracket and first connector so as to hold the first connector at a first position for connecting the second connector to the first connector and to retain the first connector at a second position to which the first connector is moved from the first position by turning.

6 Claims, 12 Drawing Sheets

ADJUSTABLE POSITION CONNECTOR MOUNTING STRUCTURE

BACKGROUND OF THE INVENTION

This invention relates to the structure for mounting connectors, and particularly to the structure for mounting connectors which can significantly improve the space utilization efficiency.

Many wire harnesses 2 are laid behind the panel of the dashboard 1 of automobiles as shown in FIG. 1. The connectors 3 of the wire harnesses 2 are connected to the connectors of switches and instruments. Conventionally high-density type connectors, with many contact-mixing terminals accommodated in a single connector 3, are used for these connectors 3. Since such high-density type connectors require a strong pressing force for connection due to the large number of the contact-making terminals, connectors of the type that is connected by the fastening force of a screw and nut are widely used.

FIGS. 2 to 4 show the structure for mounting such a conventional connector 3 inside a dashboard. The connector 3 has a bracket 4 made of a rectangular pipe being open at the rear side and the front side. The bracket 4 has mounting tabs 6 in the right and left sides, each of which is provided with a mounting hole 5. A female connector 9 is fitted to the bracket 4. In the female connector 9 a plurality of male contact-making terminals or terminals 8 are housed. The front ends of these pins 8 are protruded in the front hollow space of the female connector 9 and the rear ends are connected to the wires 7. A nut member 10 is embedded in the female connector 9. A male connector 11 is fitted into the male connector 9. In the male connector 11 a plurality of female contact-making terminals or jacks (not shown) are housed and rear ends of the jacks are connected to the wires 7. The male connector 11 is provided with a hole to insert a screw 12.

The female connector 9 is mounted to a member inside the dashboard of an automobile by means of screws 13 inserted through the mounting holes 5 in the mounting tabs 6 of the bracket 4. With the female connector 9 thus secured, the front end portion of the male connector 11 is put in the female connector 9, then a screw 12 is inserted through the male connector 11 and driven into the nut 10 in the female connector 9 by a screw-driving tool. By the fastening force of the screw 12 and nut 10 the male connector 11 is pushed into the female connector 9 and each male terminal 8 of the female connector 9 is thereby inserted into the corresponding female terminal in the male connector 11 to establish the connection.

After the connection of the connectors 9 and 11 is completed, a trim cover 14 is fitted to the dashboard section 1 to conceal the connectors 3 and wires 7.

Since the wires 7 of the male connectors 11 extend rearward horizontally, the above conventional connector-mounting structure requires a larger depth for mounting the connectors 9 and 11 to cause the decrease of the space utilization efficiency. Moreover, the wires 7 interfere with the fitting of the trim cover 14.

SUMMARY OF THE INVENTION

The object of the present invention is to provide a connector-mounting structure which can improve the space utilization efficiency and can prevent the interference of the wires thus making it easy to fix the trim cover or other parts.

This object is attained by a connector-mounting structure for mounting a pair of mating connectors for connecting wires conducting electrical current, comprising:

a bracket mounted to a member of a vehicle;

a first connector held in the bracket, holding a plurality of first terminals with wires connected to;

a second connector fitted to the first connector, holding a plurality of second terminals with wires connected to;

means for supporting the first connector turnably in the bracket; and means for retaining the first connector at a second position to which the first connector is moved from a first position by turning it in the bracket.

BRIEF DESCRIPTION OF THE DRAWINGS

FIG. 18 is a perspective view of a part of the connector-mounting structure of the embodiment shown in FIG. 17 showing the state of the female connector before the cover member is put on;

FIG. 19 is a perspective view of a part of the connector-mounting structure of the embodiment shown in FIG. 17 showing the state of the female connector after the cover member has been put on.

DETAILED DESCRIPTION OF THE PREFERRED EMBODIMENTS

Figure 1:
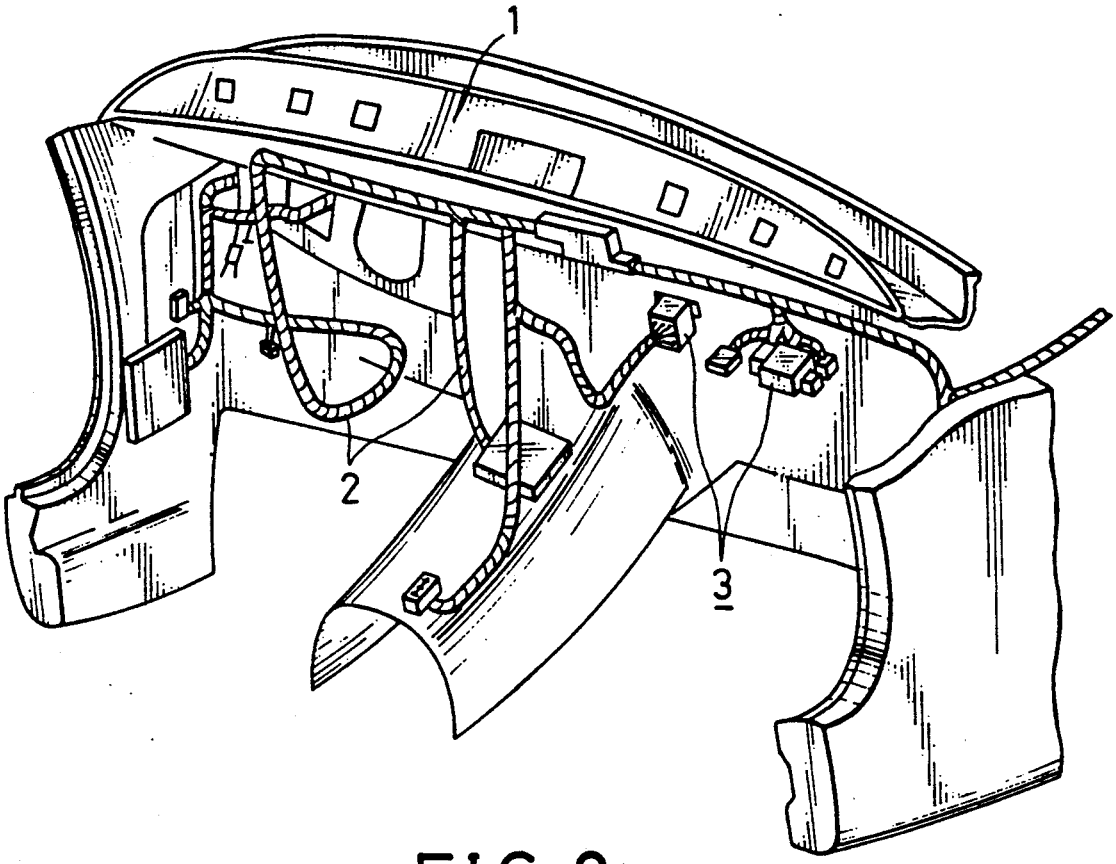
FIG. 1 PRIOR ART
FIG. 1 is a perspective view which shows the wire harnesses laid in an automobile.
Figure 2:
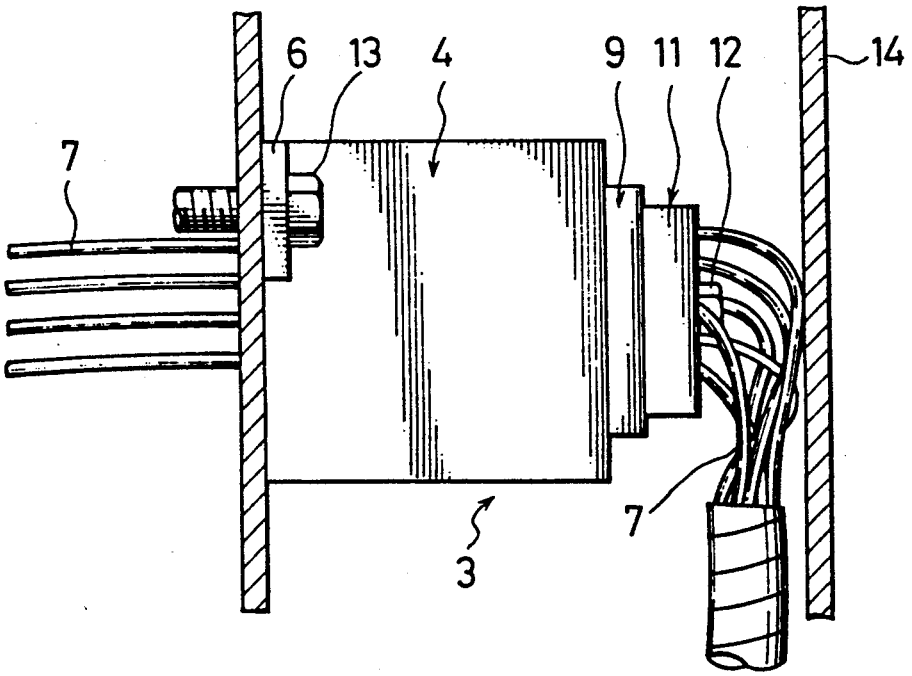
FIG. 2 PRIOR ART
FIG. 2 is a side view of a conventional connector-mounting structure.
Figure 3:
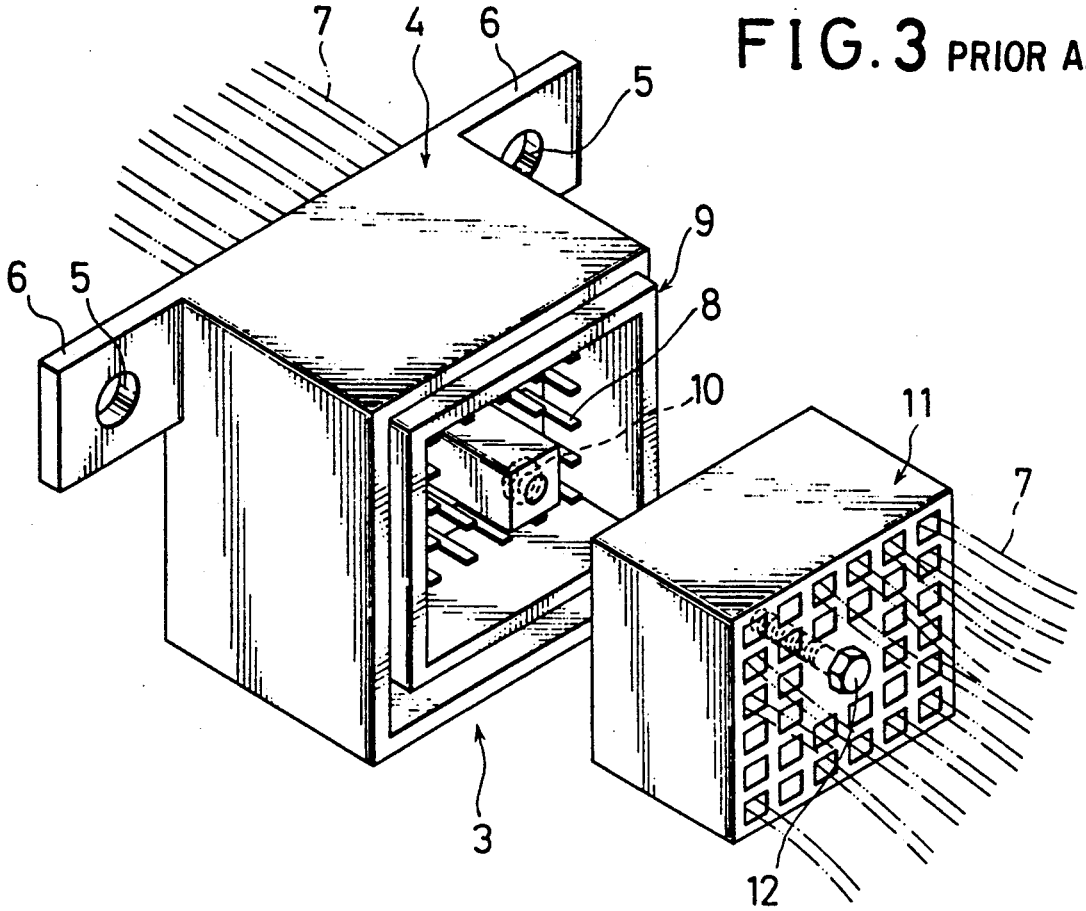
FIG. 3 PRIOR ART
FIG. 3 is a perspective view of each component of the connector-mounting structure of the conventional connector-mounting structure in FIG. 2.
Figure 4:
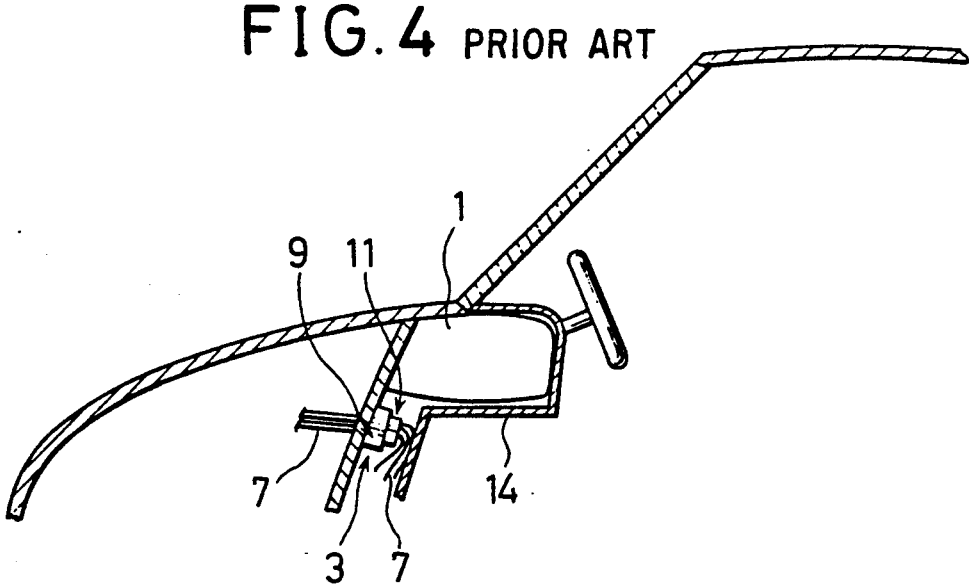
FIG. 4 PRIOR ART
FIG. 4 is a longitudinal sectional view of the part around the dashboard of an automobile.
Figure 5:
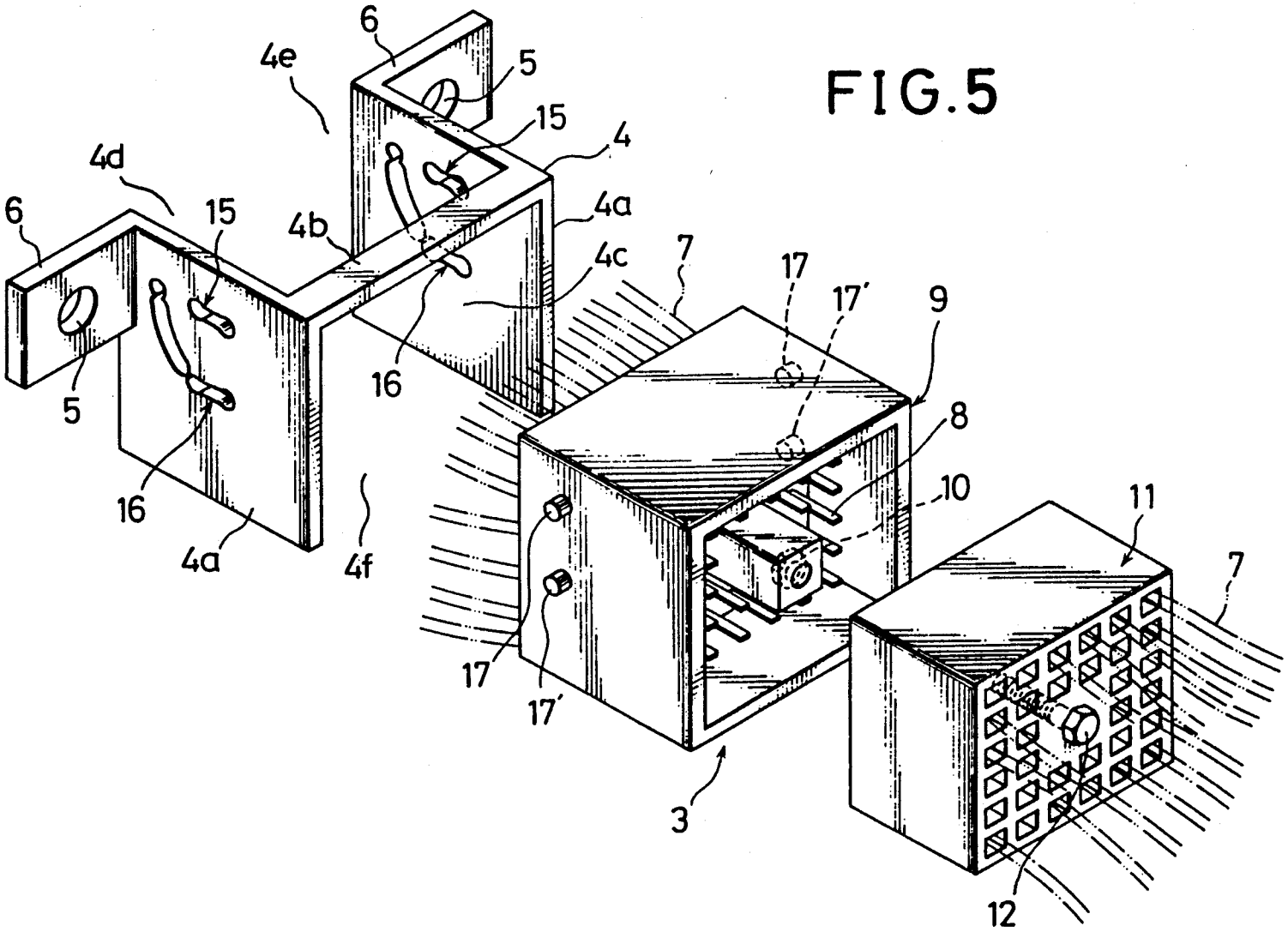
FIG. 5 is a perspective view of each component of the connector-mounting structure of the first embodiment of the present invention before mounting.
Figure 6:
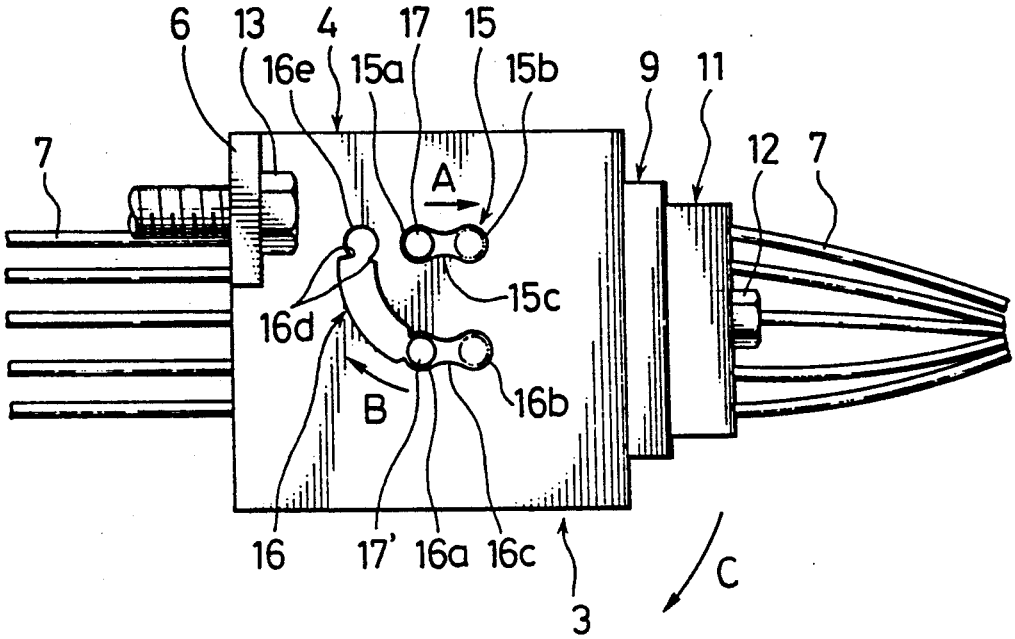
FIG. 6 is a side view of the connector-mounting structure of the embodiment shown in FIG. 5 after the male connector has been connected to the female connector and before the female connector is turned down.
Figure 7:
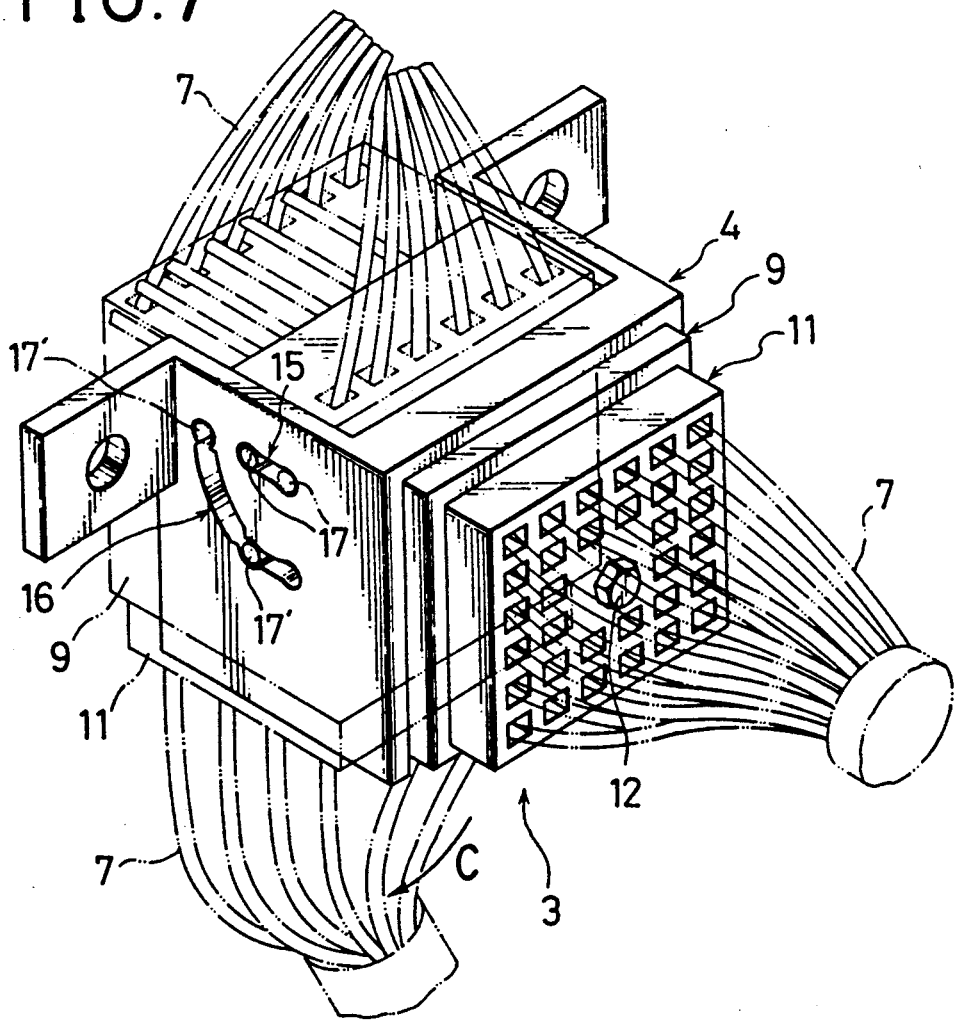
FIG. 7 shows the working of the embodiment shown in FIG. 5 and the direction of the connectors and wires before and after the female connector has been turned down.
Figure 8:
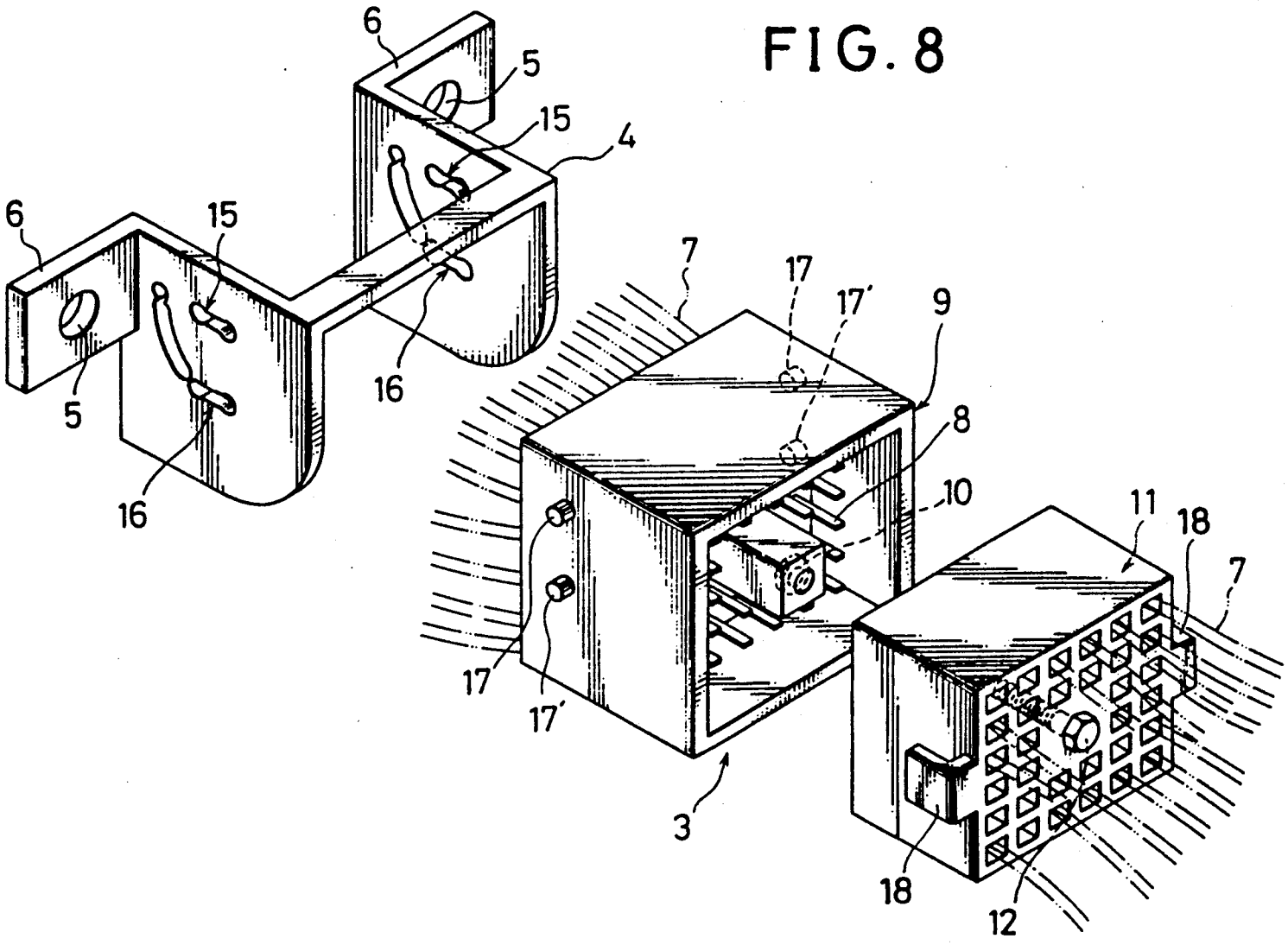
FIG. 8 is a perspective view of each component of the connector-mounting structure of the second embodiment of the present invention before mounting.
Figure 9:
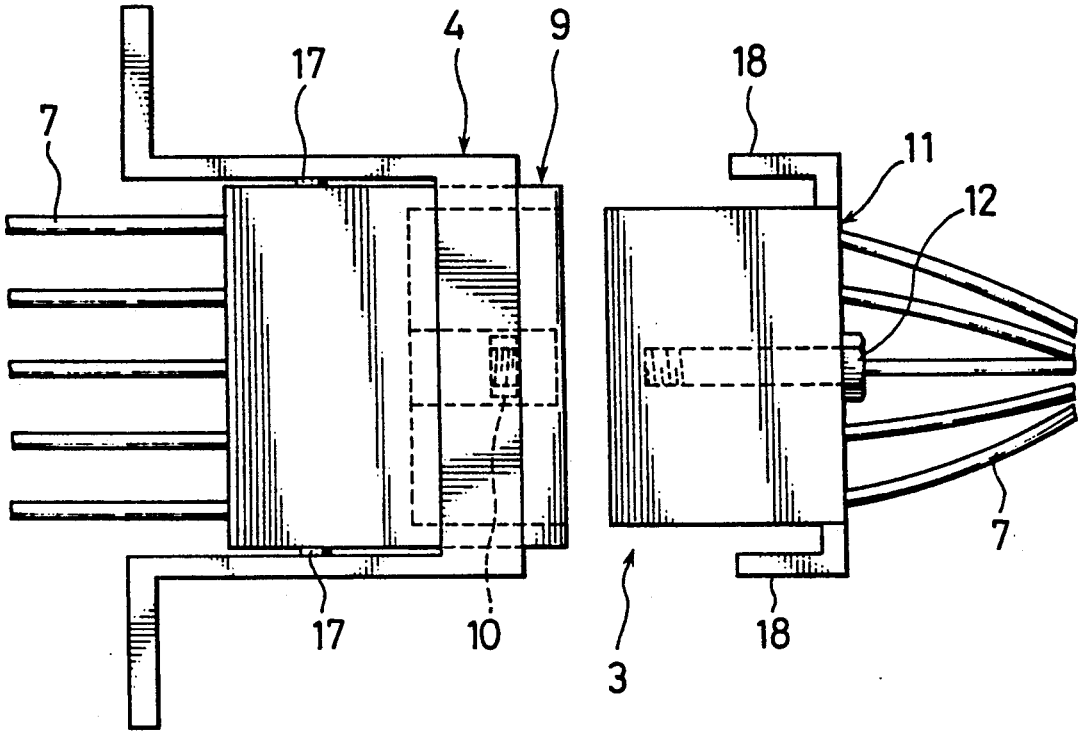
FIG. 9 is a plan view of the connector-mounting structure of the embodiment shown in FIG. 8 before the male connector is connected.
Figure 10:
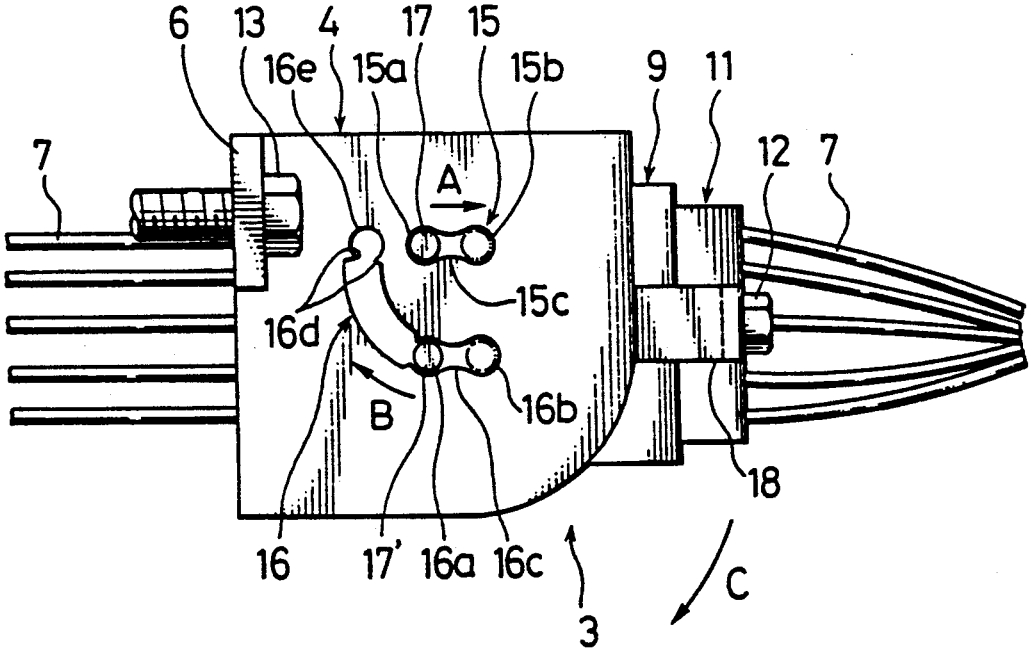
FIG. 10 is a side view of the connector-mounting structure of the embodiment shown in FIG. 8 after the male connector has been connected to the female connector and before the female connector is turned down.
Figure 11:
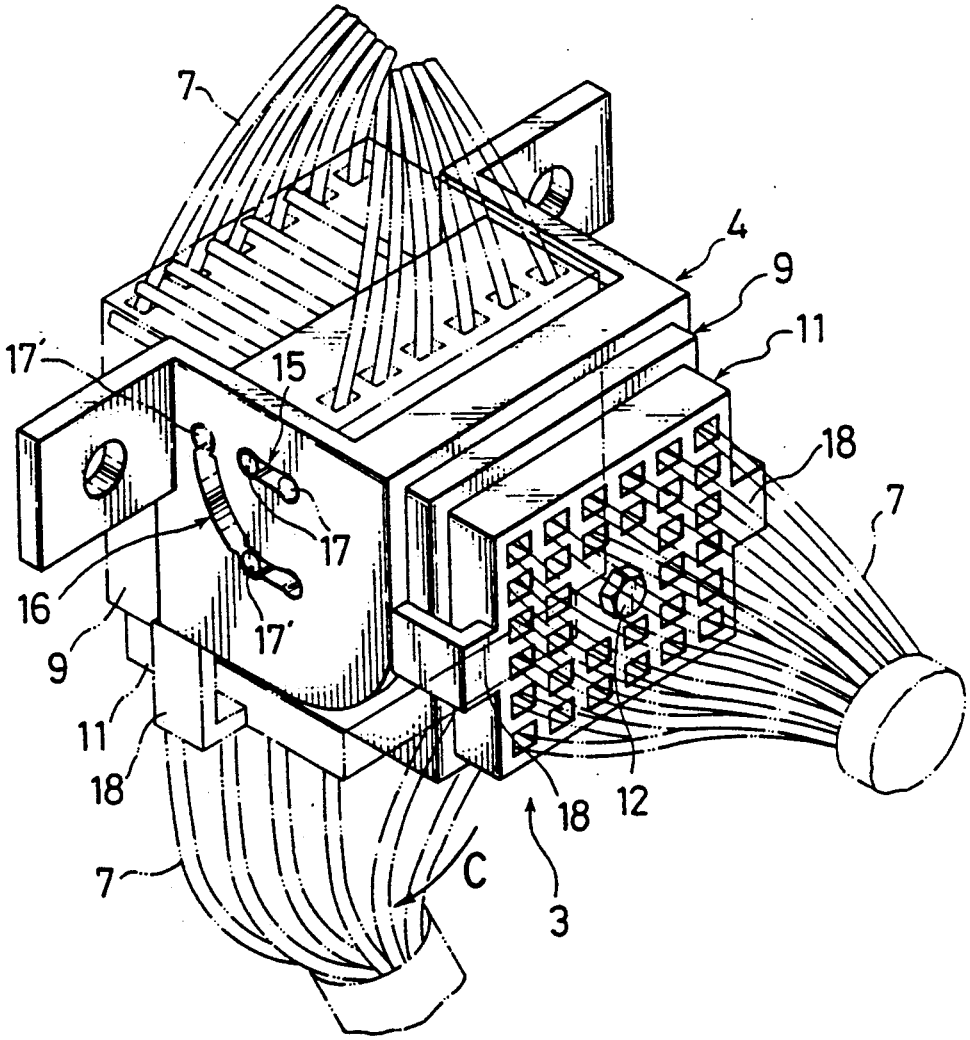
FIG. 11 shows the working of the embodiment shown in FIG. 8 and the direction of the connectors and wires before and after the female connector has been turned down.
Figure 12:
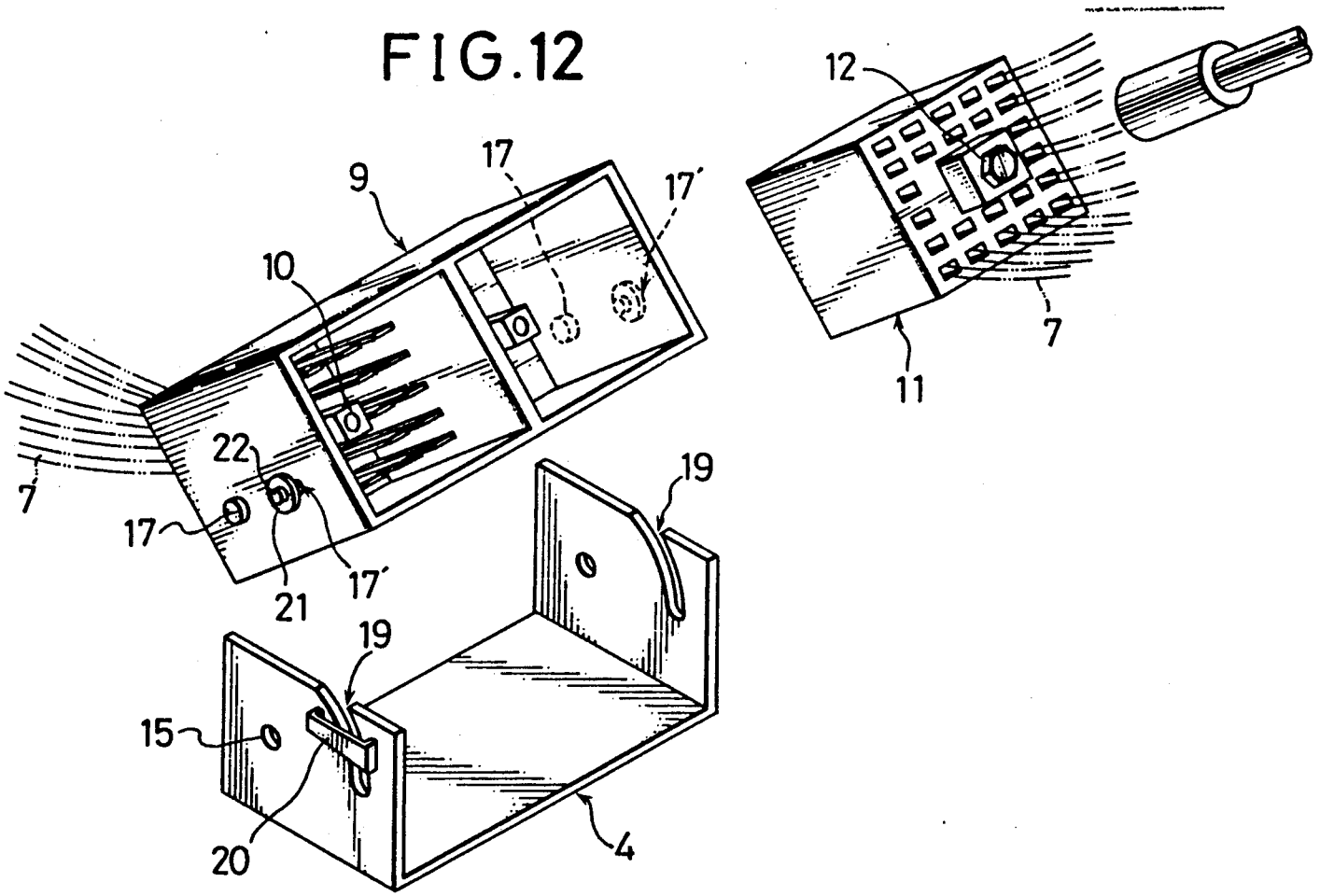
FIG. 12 is a perspective view of each component of the connector-mounting structure of the third embodiment of the present invention before mounting.
Figure 13A:
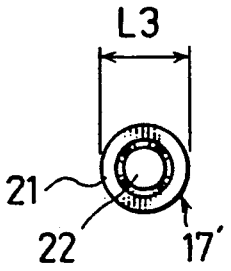
FIG. 13 shows one of the stopper pins of the embodiment shown in FIG. 12. (A) is a view from the left side of the female connector and (B) is a view from the front side of the female connector.
Figure 13B:
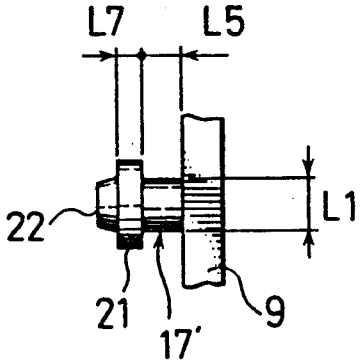
Figure 14A:
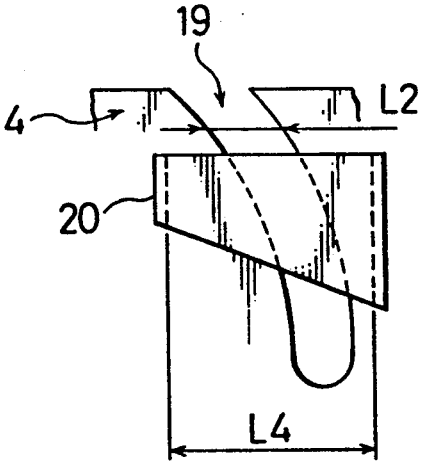
FIG. 14 shows a turn-side guide slot and stopper member of the embodiment shown in FIG. 12, (A) is a view from the left side of the female connector and (B) is a view from the front side of the female connector.
Figure 14B:
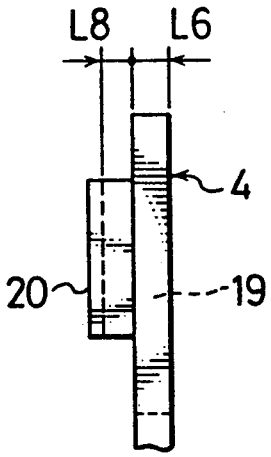

FIGS. 5 to 7 show the first embodiment of the present invention. The connector-mounting structure of this embodiment comprises a bracket 4. The bracket 4 is made up of a pair of opposite side members 4*a* and a traverse connecting member 4*b* which connects the side members 4*a* at their front part of the top end. The bracket 4 has thus a front opening 4*c* through which a female connector 9 is inserted, a rear opening 4*d* through which the wires extending from a female connector 9 pass, and a top opening 4*e* and a bottom opening 4*f* which allow the turn of a female connector 9 described below. A mounting tab 6 with a mounting hole 5 is formed integrally at the upper part of the rear end of each side member 4*a*. Further in this embodiment, a center-side guide slot 15 which guides the center of the turn of the female connector 9 and a turn-side guide slot 16 located below the center-side guide slot 15 are provided in each side member 4*a*.

The center-side guide slot 15 comprises insertion part 15*a* and center part 15*b* to the front side of the insertion part 15*a*, with narrow part 15*c* between them. The turn-side guide slot 16 is formed in an arc with the center part 15*b* of the center-side guide slot 15 as its center and extending from below to behind the center-side guide slot 15 so as to form the central angle of about 90 degrees. Formed at the front end portion of the turn-side guide slot 16 is insertion part 16*a* and turn-starting part 16*b* to the front side of the insertion part 16*a*, with narrow part 16*c* between them. Further retaining part 16*e* defined by stopping projections 16*d* is also formed at the rear end of the turn-side guide slot 16*e*.

A female connector 9 is inserted and held in the bracket 4. In the female connector 9 a plurality of male terminals (pins) 8 with wires 7 connected thereto are housed and a nut 10 is embedded as described above. Further in this embodiment, a pivot pin 17 and a stopper pin 17′ are formed in each side of the female connector 9 so as to project from the face of each side and to be aligned nearly in a vertical line. Each pivot pin 17 is put in the center-side guide slot 15 in each side member 4*a* of the bracket 4. Each stopper pin 17′ is put in the turn-side guide slot 16 in each side member 4*a* of the bracket 4 to guide the turn of the female connector 9 and then retain the female connector 9 at the turned position.

A male connector 11 is fitted into the female connector 9. In the male connector 9, a plurality of female terminals (jacks) (not shown) with wires 7 connected to are housed and a hole for passing a screw 12 to be screwed into the nut 10 in the female connector 9 is provided.

Next described is the working of the connector-mounting structure of the first embodiment.

First, the female connector 9 is placed in the bracket 4 so that the pivot pins 17 and stopper pins 17′ are put in the center-side guide slots 15 and turn-side guide slots 16 respectively, by inserting it into the bracket 4 forcing apart the side members 4*a* of the bracket 4. The bracket 4 with the female connector 9 placed therein is then mounted to a member behind the panel of the dashboard or the like of an automobile by means of screws 13 passed through the mounting holes 5 in the mounting tabs of the bracket 4.

Next the front end portion of the male connector 11 is put in the female connector 9, then a screw 12 is inserted through the male connector 11 and driven into the nut 10 in the female connector 9 by a screw-driving tool. By the fastening force of the screw 12 and nut 10 the male connector 11 is pushed into the female connector 9, and each male terminal 8 of the female connector 9 is thereby inserted into the corresponding male terminal in the male connector 11 to establish the connection. Until the connection of the connectors 9 and 11 is completed, the pivot pins 17 and stopper pins 17′ are retained in the insertion parts 15*a* of the center-side slots 15 and those of the turn-side slots 16 by the narrow parts 15*c* and 16*c*, respectively.

After the connection of the connectors 9 and 11 is completed, the male connector 11 is pulled in the direction shown by arrow A with a strong force. The pivot pins 17 and stopper pins 17′ are thereby moved into the center parts 15*b* of the center-side guide slots 15 and the turn-starting parts 16*b* of the turn-side guide slots 16 with passing through the narrow parts 15*c* and 16*c*, respectively. From this position, since the turn-side guide slots 16 are formed in an arc with the center part 15*b* of the center-side guide slot 15 as its center as described above, the stopper pins 17′ can be moved along the turn-side guide slots 16 in the direction shown by arrow B. The connectors 9 and 11 are thereby turned in the direction as shown by arrow C. The stopper pins 17′ are moved until they enter the retaining parts 16*e* of the turn-side slots 16, and once caught in the retaining parts 16*e* they are retained there by the stopping projections 16*d* to hold the connectors 9 and 11 in that substantially vertical direction.

Since the female connector 9 and male connector 11 are thus mounted in a substantially vertical position, the wires 7 of the male connector 11 are directed downward. Therefore, the problem of the rearward protrusion of the wires 7 from the male connector 11 at the initial position of the connectors can be resolved.

Since, in this embodiment, the wires 7 of the male connector 11 can be directed downward by turning the female connector 9 and male connector 11 as described above, the depth required for accommodating the connectors becomes smaller and the space utilization efficiency is improved. Moreover, since the wires 7 do not interfere, the fixing work of a trim cover or other parts is made much easier.

FIGS. 8 to 11 show the second embodiment of the present invention. The connector-mounting structure of this embodiment comprises a bracket 4 similar to that of the first embodiment. The front lower part of the bracket 4 of this embodiment is formed in an arc with the center parts 15*b* of the center-side guide slots 15 or its vicinity as its center. Further, L-shaped stopper arms 18 are formed at the right and left sides of the male connector 11 in such a manner that their front ends come into contact with the front end of the bracket 4. The other construction is the same as that of the first embodiment, and therefore the same components are designated by the same numerals with no description given.

Next described is the working of the connector-mounting structure of the second embodiment.

First, the female connector 9 is placed in the bracket 4 and the bracket 4 is then mounted to a member behind the panel of the dashboard or the like of an automobile in the same manner as in the structure of the first embodiment.

Next in the same manner as in the first embodiment, the front end portion of the male connector 11 is put in the female connector 9, then a screw 12 is inserted through the male connector 11 and driven into the nut 10 in the female connector 9 by a screw-driving tool. By the fastening force of the screw 12 and nut 10 the male connector 11 is pushed into the female connector 9, and each male terminal 8 of the female connector 9 is thereby inserted into the corresponding female terminal in the male connector 11 to establish the connection. Until the connection of the connectors 9 and 11 is completed, the pivot pins 17 and stopper pins 17' are retained in the insertion parts 15*a* of the center-side slots 15 and those of the turn-side slots 16 by the narrow parts 15*c* and 16*c*, respectively.

However, in the structure of this embodiment, the stopper arms 18 come into contact with the front end of the bracket 4 as the screw 12 is driven into the nut 10. Thereafter the insertion of the male connector 9 is prevented and the female connector 9 is pulled toward the male connector 11 in the direction shown by arrow A by the fastening force of the screw 12 and nut 10. By this force, the pivot pin 17 and stopper pins 17' of the female connector 9 move to the center part 15*b* of the center-side guide slots 15 and the turn-starting part 16*b* of the turn-side guide slots 16 with passing through the narrow parts 15*c* and 16*c*, respectively. After the screw 12 is completely driven, the connectors 9 and 11 can be turned downward in the direction shown by arrow C by moving the stopper pins 17' along the guide slots 16 turning around the pivot pins 17 in the direction shown by arrow B. Consequently the stopper pins 17' are caught and retained by the retaining parts 16*e*, holding the connector 11 in a substantially vertical position.

The connector mounting structure of this second embodiment, as the first embodiment, can also improve the space utilization efficiency and make easier the fixing work of the dashboard or other parts.

Therefore, the depth required for accommodating the connectors becomes smaller and the space utilization efficiency is improved. Moreover, since the wires 7 do not interfere, the fixing work of a trim cover or other parts is made much easier.

Further in the mounting structure of the second embodiment, since the insertion of the male connector 11 and the move of the pivot pins 17 and stopper pins 17' are performed by the driving of the screw 12, the turning of the connectors 9 and 11 can be carried out immediately after the driving of the screw 12 is completed and as the result the work efficiency is improved.

FIGS. 12 to 16 show the third embodiment of the present invention. The connector-mounting structure of this embodiment comprises a bracket 4, which is provided with two side members connected at their bottom ends to a bottom member. Formed in each side member are a pivot hole 15 and a turn-side guide slot 19. The turn-side guide slots 19 are formed in an arc with the pivot hole 15 as its center, extending from the upper front of the pivot hole 15 to the front side so as to form a center angle of about 45 degrees. The upper ends of the guide slots 19 open at the top ends of the side members. Formed in the outer side of each side member of the bracket 4 is a stopper member 20 nearly in the rectangular shape so as to protrude from the face of the side member and cross about the middle part of the guide slot 19.

A female connector 9, in which a plurality of male terminals 8 with wires 7 connected to are housed and a nut 10 is embedded, is inserted and held in the bracket 4. A pivot pin 17 and a stopper pin 17' are formed in each side of the female connector 9 so as to project from the face of each side. The diameter L1 of the stopper pins 17' is smaller than the width L2 of the guide slots 19. Formed at the middle part of the stopper pins 17' is a flange part 21, the diameter L3 of which is determined so as to be greater than the width L2 of the guide slot 19 and smaller than the inner width L4. Further, the height L5 from the face of the side member of the bracket 4 to the inner side of the flange part 21 is larger than the thickness of the side member and the thickness L7 of the flange part 21 is smaller than the distance L8 from the face of the side member to the inner side of the stopper 20. By this structure, when the stopper pins 17' are put in the guide slots 19, the flange parts 21 are positioned outside each side member of the bracket 4 and pass through the inside of the stoppers 20. Furthermore, a truncated conical part 22 is formed outside the flange part 21 of each stopper pin 17' in such a manner that the truncated conical part 22 comes into contact with the stopper 20 and elastically deform the stopper 21 when the flange part 21 passes through the stopper 20.

Other structures of the male connector 11 connected to the femal connector 9 is the same as that of the first embodiment.

Next described is the working of the connector-mounting structure of the third embodiment.

Figure 15:
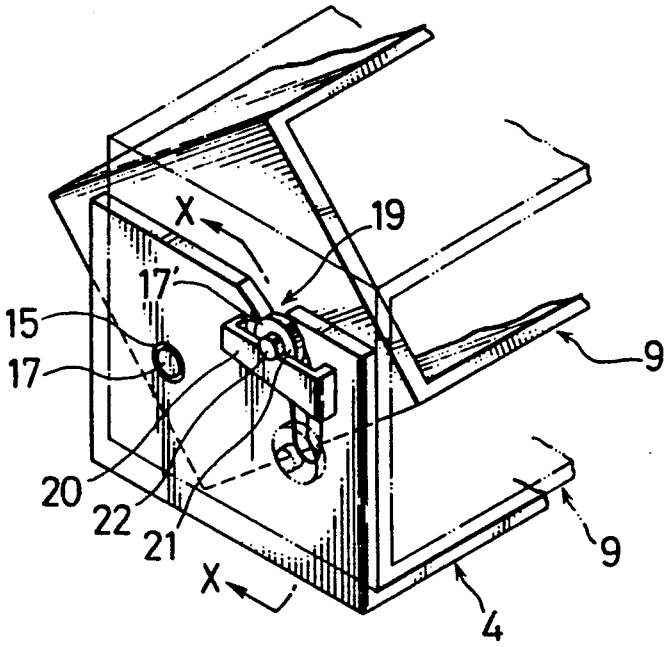
FIG. 15 is a perspective view of a part of the connector-mounting structure of the embodiment shown in FIG. 12 showing the state of the female connector before the male connector is connected.

First, the female connector 9 is placed in the bracket 4 so that the pivot pins 17 are put in the center holes 15 and the stopper pins 17' are put in the guide slots 19. Then the bracket 4 is mounted to a member behind the panel of the dashboard or the like of an automobile. At this stage, the truncated conical parts 22 of the stopper pins 17' are in contact with the stoppers 20 of the bracket 4 and the female connector 9 is supported at the connecting position as shown in FIG. 15.

Next the front end portion of the male connector 11 is put in the female connector 9, then a screw 12 is inserted through the male connector 11 and driven into the nut 10 in the female connector 9 by a screw-driving tool. By the fastening force of the screw 12 and nut 10 the male connector 11 is pulled into the female connector 9.

Figure 16A:
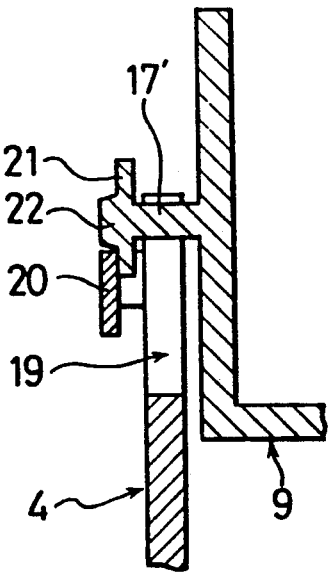
FIG. 16 is a part of the sectional view along the X—X line in FIG. 15, (A) shows the state before the female connector is turned down, (B) shows that in the middle of the turning, and (C) shows that after the female connector has been turned down.
Figure 16B:
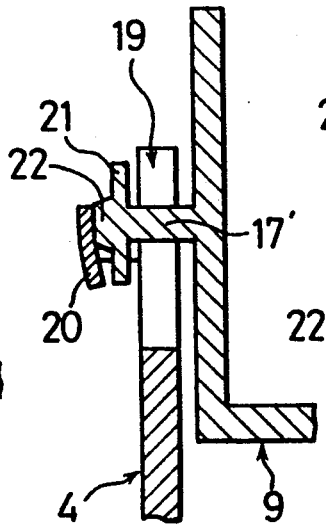
Figure 16C:
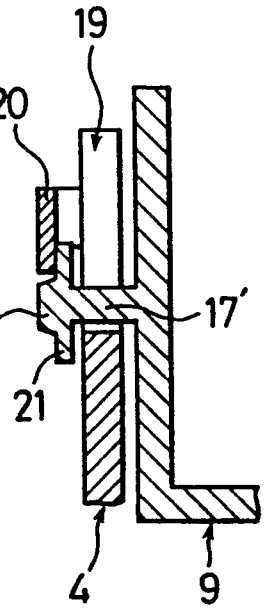
Figure 17:
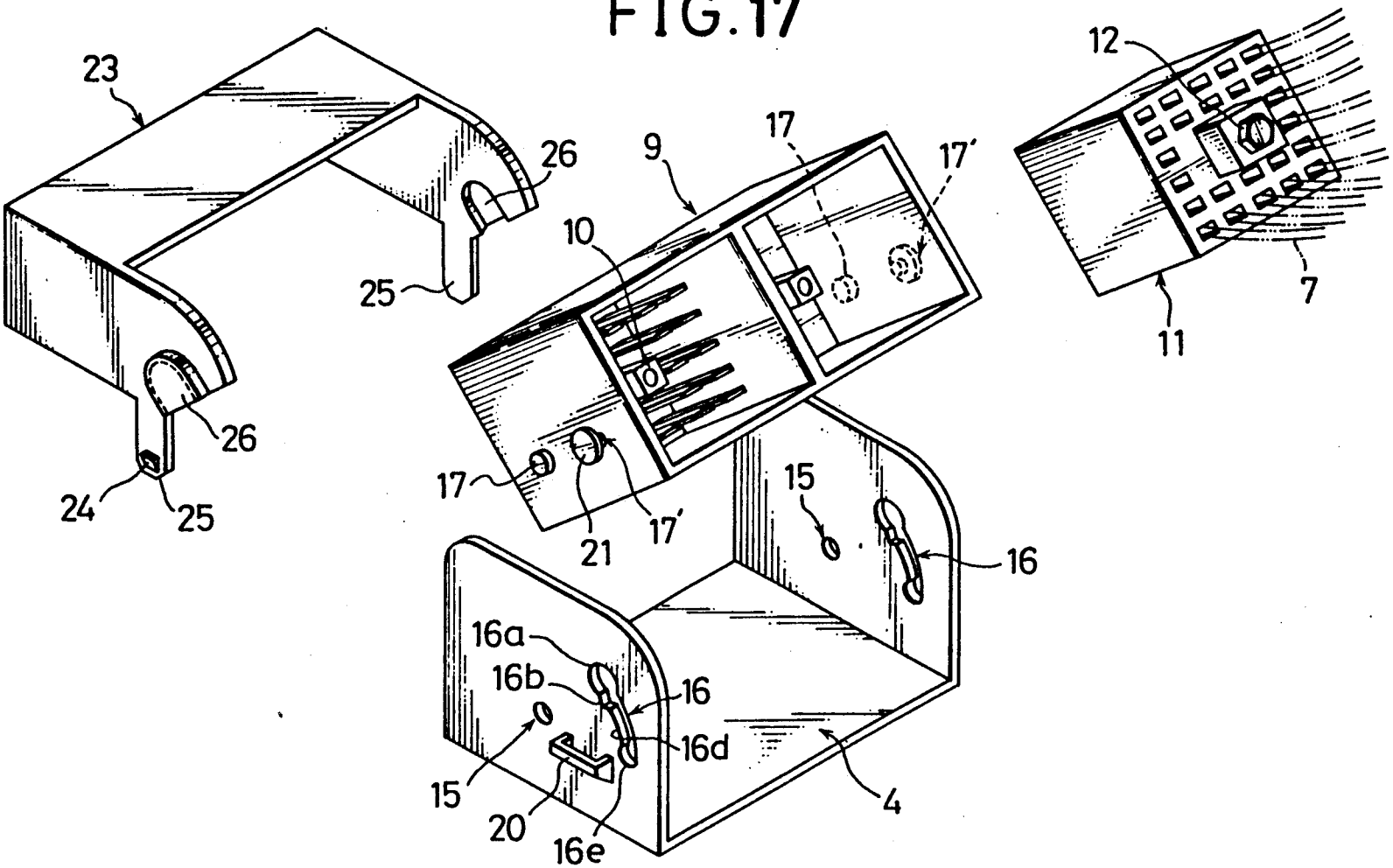
FIG. 17 is a perspective view of each component of the connector-mounting structure of the fourth embodiment of the present invention before mounting.

After the connection of the connectors 9 and 11 is completed as shown in FIG. 16 (A), the male connector 11 is pushed down. By this pressing force, the truncated conical parts 22 of the stopper pins 17' elastically deform the stopper 21 and the flange parts 21 pass through the stoppers 20. After the flange parts 21 pass through the stoppers 20, the stoppers 20 recover to the normal shape to retain the truncated conical parts 22 below the stoppers 20 as shown in FIG. 16 (*c*). The connectors 9 and 11 are thus secured in the direction substantially parallel to the dashboard as shown in the dash and dotted lines in FIG. 15 and the problem of the rearward protrusion of the wires 7 of the connectors can be resolved.

The connector mounting structure of this third embodiment, as the previous embodiments, can also improve the space utilization efficiency and make easier the fixing work of the dashboard or other parts.

Further, since the truncated conical parts 22 of the stopper pins 17' of the female connector 9 come into contact with the stoppers 20 of the bracket 4 and are stopped to that position in this third embodiment, the female connector 9 is supported at the connecting position until the male connector 11 is connected. When the male connector 11 is pushed down after the connection is completed, the truncated conical parts 22 elastically deform the stoppers 20 and pass through them. The truncated conical parts 22 are then retained by the recovered stoppers 20 below them and hold the connectors in that direction. Since the truncated conical parts 22 are thus retained by the elastic deformation of the stoppers 20, the change of resisting force when the conical parts 22 pass through the stoppers 20 is clearly felt while pushing down the male connector 11. Therefore, loosening of the female connector 9 due to incomplete pushing can be prevented reliably.

FIGS. 17 to 20 show the fourth embodiment of the present invention. The bracket 4 of this embodiment is provided with two side members connected at their bottom ends by a bottom member. Formed in each side member are a pivot hole 15 and a turn-side guide slot 16. The turn-side guide slots 16 are located to the front side of the pivot hole 15 and formed in an arc with the pivot hole 15 as its center and with a center angle of about 45 degrees. A catch member 20 is provided between the pivot hole 15 and the turn-side guide slot 16 in each side member of the bracket 4. The catch members 20 are nearly in the rectangular shape and protruding from the face of each side member. Insertion part 16*a* is formed at the upper end portion of each turn-side guide slot 16 and below the insertion part 16*a* the turn-starting part 16*b* is formed continuously with the insertion part 16*a*. Formed at the bottom end portion of the turn-side guide slot 16 is retaining part 16*e* defined by stopping projections 16*d*.

A female connector 9 is placed in the bracket 4. Pivot pins 17 and stopper pins 17' are formed in the right and left sides of the female connector 9. The pins 17 are put in the center holes 15, and the stopper pins 17' are put in the turn-side guide 16. Formed at the top portion of each stopper pin 17' is a flange 21. The diameter of the flanges 21 is smaller than that of the insertion-part 16*a* of the guide slots 16. The height L5 from each side of the female connector 9 to the inner side of the flange 21 of each stopper pin 17' is greater than the thickness L6 of the side members of the bracket 4.

A male connector 11 is the same as those in the previous embodiments. A cover 23 in the rectangular shape is put on the bracket 4 to cover the open top side of the bracket 4. The cover 23 is provided with a leg 25 at the front bottom part of each side member. The legs 25 are inserted into and caught by the catch members 20 of the bracket 4 and provided with a locking projection 24 at the bottom for locking. A stopping part 26 is formed in each side member of the bracket 26 so as to protrude outside. The stopping parts 26 cover the upper portion of the guide slots 16. The height L9 of the stopping parts 26, that is the distance from the inner surface of each side member of the cover 23 to the inner side of each stopping part is determined so that it is greater than the thickness L7 of the flange 21 of the stopper pins 17'.

Next described is the working of the connector-mounting structure of the fourth embodiment.

Figure 19:
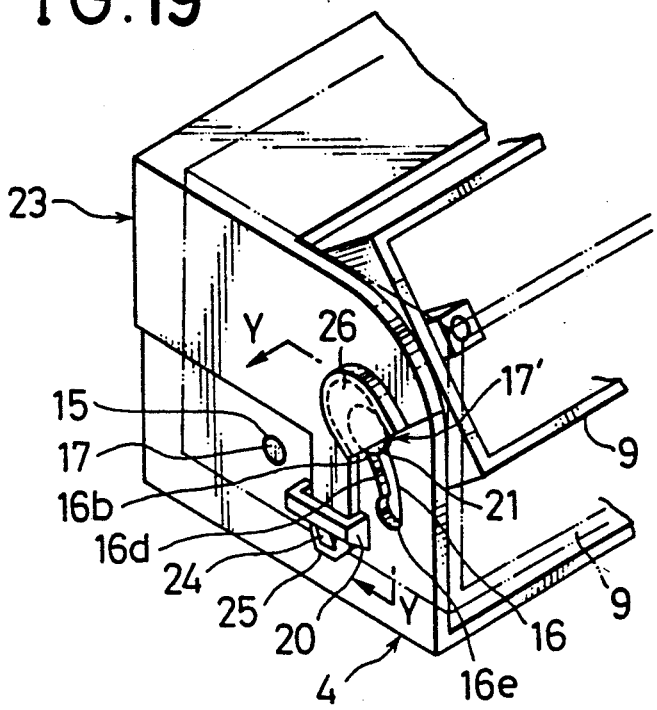
Figure 18:
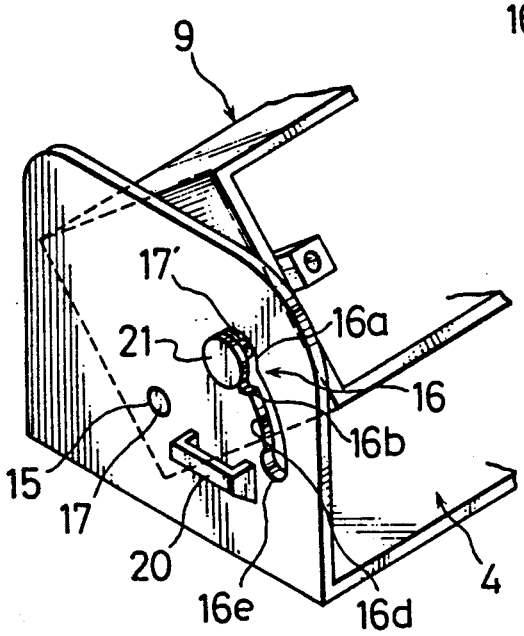
Figure 20:
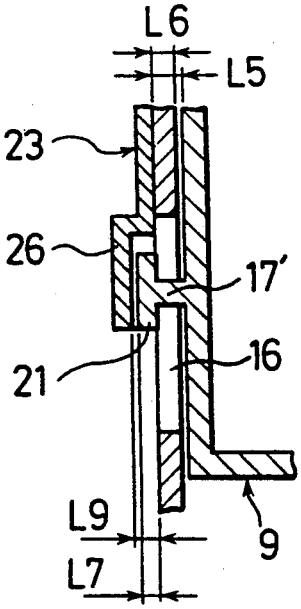
FIG. 20 is a part of the sectional view along the Y—Y line in FIG. 19.

The female connector 9 is placed in the bracket 4. The pivot pins 17 are put in the center holes 15 and the stopper pins 17' are put in the guide slots 16 as shown in FIG. 18. The stopper pins 17' are put in the guide slots 16 by passing the flange 21 of the stopper pins 17' through the insertion part 16*a* of the guide slots 16 and supported by the turn-starting part 16*b* of the guide slots 16. Then the cover 23 is put on the bracket 4 so as to cover the open top side of the bracket 4 as shown in FIGS. 19 and 20. The bottom end portion of the legs 25 of the cover 23 is passed through each catch member 20. The flanges 21 of the stopper pins 17' are covered by the stopping parts 26 of the cover 23, and the female connector 9 is thereby secured in the connecting position.

Next the bracket 4, with the female connector 9 and cover 23 put on, is mounted inside a dashboard. Then the male connector 11 is connected to the female connector 9 by driving the screw 12 of the male connector 11 into the nut 10 of the female connector 9. After the connection is completed, the male connector 11 is pushed downward to move the stopper pins 17' into the retaining parts 16*e* of the guide slots 16 passing through the stopping projections 16*d*. The stopper pins 17' are then caught in the retaining parts 16*e*. The connectors 9 and 11 are thereby retained at the position shown in the dash and dotted lines in FIG. 19 so that the wires 7 of the connectors extends parallel with the dashboard.

The connector mounting structure of this fourth embodiment can also improve the space utilization efficiency and make easier the fixing work of the dashboard or other parts.

Moreover, since the cover 23 is put on to cover the open side of the bracket 4 with the female connector 9 placed in, this embodiment has the following effects. The female connector 9 is more firmly secured to the bracket 4. The side members of the cover 23 overlap those of the bracket 4 and the strength of the bracket 4 is reinforced. Consequently the connection of the male connector 11 and the turning of the connectors are made easier.

Though, in the above embodiments 1 to 4, the guide slots and holes 15 are formed in the bracket 4 and the pins 17, 17' in the female connector 9, they may be formed reversely, that is, the slots and holes in the connector and the pins in the bracket. By this reverse structure too, the same effects can be attained.

Furthermore, though screw-connected connectors are used in the description of the above embodiments, other types of connectors can also be used.

Moreover, the connector-mounting structure of this invention can retain connectors not only in the vertical direction as in the description of the above embodiments but also in any desired direction by simple modifications.

The connector-mounting structure of this invention can retain connectors not only in the vertical direction as in the description of the above embodiments but also in any desired direction by simple modifications, and can be used in various applications in which more efficient utilization of space or prevention of the interference of connector wires is required.

What is claimed is:

1. A connector-mounting structure for mounting a pair of mating connectors for connecting wires conducting electrical current, comprising:

a bracket mounted to a member of a vehicle;

a first connector held in the bracket, holding a plurality of first terminals with wires connected thereto;

a second connector fitted to the first connector, holding a plurality of second terminals with wires connected thereto;

means for supporting the first connector with the second connector fitted thereto in the bracket, said means for supporting the first connector with the second connector fitted thereto in the bracket comprising pivot pins formed in the first connector and center-side guide slots formed in the bracket in which the pivot pins are received; and;

means for retaining the first connector at a second position to which the first connector is moved from a first position by turning it in the bracket, said means for retaining the first connector at the second position comprising stopper pins formed in the first connector, arc-shaped turn-side guide slots formed in the bracket so as to guide the stopper pins from the first position to the second position, and stopping members formed at the end of said turn-side guide slots for preventing the backward movement of the stopper pins from the second position.

2. A connector-mounting structure of claim 1, wherein said center-side guide slots each comprises an insertion part for receiving each pivot pin, a center part for holding each pivot pin therein when turning the first connector, and narrow part connecting the insertion part and the center part;

said turn-side guide slots each comprising an insertion part for receiving each stopping pin, a turn-starting part to which each stopping pin is moved when each pivot pin is moved to the center part, a guide part in the form of an arc with the center part of each center-side guide slot as its center, and a retaining part defined by each of said stopping members at the end of the guide part; and each of said stopping members being a stopping projection formed at the end of the guide part so as to project in the guide part.

3. A connector-mounting structure of claim 2, wherein said first connector is provided with a nut member; and said second connector is provided with a hole through which a screw member is passed to be driven into the nut member, and with stopper members in such a manner that they come into contact with the bracket and then pull the first connector toward the second connector so as to move said pivot pins to said center parts of said center-side guide slots and said stopper pins to said turn-starting parts of said turn-side guide slots, as the second connector is pushed into the first connector by the fastening force of the nut and screw members.

4. A connector-mounting structure for mounting a pair of mating connectors for connecting wires conducting electrical current, comprising;

a bracket mounted to a member of a vehicle;

a first connector held in the bracket, holding a plurality of first terminals with wires connected thereto;

a second connector fitted to the first connector, holding a plurality of second terminals with wires connected thereto;

means for turnably supporting the first connector with the second connector fitted thereto turnably in the bracket, said means for turnably supporting the first connector with the second connector fitted thereto in the bracket comprising pivot pins formed in said first connector and center holes formed in the bracket adapted to receive the pivot pins; and means for retaining the first connector at a second position to which the first connector is moved from a first position by turning it in the bracket, said means for retaining the first connector at the second position comprising stopper pins formed in the first connector, turn-side guide slots formed in the bracket in an arc with the center holes as their center and with their insertion side open, and stopping members bridging the turn-side guide slots for restraining the stopper pins after being passed under the stopping members in a direction away from the insertion side of the turn-side guide slots.

5. A connector-mounting structure for mounting a pair of mating connectors for connecting wires conducting electrical current, comprising:

a bracket mounted to a member of a vehicle;

a first connector held in the bracket, holding a plurality of first terminals with wires connected thereto;

a second connector fitted to the first connector, holding a plurality of second terminals with wires connected thereto;

means for turnably supporting the first connector with the second connector fitted thereto in the bracket; said means for turnably supporting the first connector with the second connector fitted thereto in the bracket comprising pivot pins formed in said first connector and center holes formed in the bracket adapted to receive the pivot pins; and means for retaining the first connector at a second position to which the first connector is moved from a first position by turning it in the bracket, said means for retaining the first connector at the second position comprising stopper pins formed in the first connector and provided with a flange part at an outer end portion thereof, turn-side guide slots each comprising an insertion part for receiving each stopping pin, a guide part in the form of an arc with the center hole as its center, stopping projections formed at the end of each guide part and a retaining part defined by each of said stopping projections; and further comprising a cover member adapted to cover the bracket with the first connector placed therein and covering the flange parts of the stopper pins at the insertion parts, and further having means for holding securely the first connector to the bracket in the assembled condition.

6. The connector-mounting structure of claim 5, wherein said securing means comprises a projection extending from the cover member, and a catch member disposed on the bracket for receiving the projection in locking engagement.

* * * * *